US006767276B2

(12) United States Patent
Keller

(10) Patent No.: US 6,767,276 B2
(45) **Date of Patent: *Jul. 27, 2004**

(54) HOLDER FOR FLAT WORKPIECES, PARTICULARLY SEMICONDUCTOR WAFERS

(75) Inventor: Thomas Keller, Osterronfeld (DE)

(73) Assignee: Peter-Wolters CMP-Systeme GmbH & Co. KG, Rendsburg (DE)

( * ) Notice: Subject to any disclaimer, the term of this patent is extended or adjusted under 35 U.S.C. 154(b) by 86 days.

This patent is subject to a terminal disclaimer.

(21) Appl. No.: 10/017,243

(22) Filed: Dec. 13, 2001

(65) Prior Publication Data

US 2002/0077051 A1 Jun. 20, 2002

(30) Foreign Application Priority Data

Dec. 14, 2000 (DE) ..... 100 62 496

(51) Int. Cl.[7] ..... B24B 47/02

(52) U.S. Cl. ..... 451/328; 451/287; 451/288; 451/289; 451/398

(58) Field of Search ..... 451/41, 288, 287, 451/289, 388, 398

(56) References Cited

U.S. PATENT DOCUMENTS

| | | | | | |
|---|---|---|---|---|---|
| 6,093,091 | A | * | 7/2000 | Keller | 451/388 |
| 6,503,134 | B2 | * | 1/2003 | Shendon | 451/398 |
| 6,506,104 | B2 | * | 1/2003 | Perlov et al. | 451/288 |
| 6,506,105 | B1 | * | 1/2003 | Kajiwara et al. | 451/289 |

FOREIGN PATENT DOCUMENTS

| | | |
|---|---|---|
| DE | 195 44 328 | 5/1996 |
| DE | 197 55 975 | 6/1999 |
| EP | 0 922 531 | 6/1999 |

* cited by examiner

*Primary Examiner*—Joseph J. Hail, III
*Assistant Examiner*—Alvin J Grant
(74) *Attorney, Agent, or Firm*—Vidas, Arrett & Steinkraus P.A.

(57) ABSTRACT

A holder for semiconductor wafers in an apparatus for chemical-mechanical polishing of semiconductor wafers, having a disk-shaped head, a holding plate and a ring-shaped membrane attached to the carrier section and the holding plate which defines a pressure chamber between these components, the bores in the holding plate being connected with the pressure chamber, a contact membrane of elastomeric gas-impermeable material having a peripheral edge which is fixedly connected to a peripheral portion of the holding plate in a gas-tight manner and engages the lower side of the holding plate.

6 Claims, 2 Drawing Sheets

HOLDER FOR FLAT WORKPIECES, PARTICULARLY SEMICONDUCTOR WAFERS

CROSS-REFERENCE TO RELATED APPLICATIONS

Not Applicable.

STATEMENT REGARDING FEDERALLY SPONSORED RESEARCH

Not Applicable

BACKGROUND OF INVENTION

The invention relates to a holder for flat workpieces, particularly semiconductor wafers, particularly in an apparatus for chemico-mechanically polishing the semiconductor.

The miniaturization of semiconductor components which has steadily intensified over the recent years causes more stringent and new demands to the manufacturing process of the electronic components. Thus, the surface of the semiconductor material to be exposed during the lithographic pitting process has to be very flat (the difference in profile being less than 0.4 $\mu$m) if the structure sizes are less then 0.5 $\mu$m in order to lie within the focussing plane. To this effect, the material needs to be planarized by means of suitable devices.

A process serving the purpose is the Chemical Mechanical Polishing (CM). In this process which uses a polishing agent which is both corrosive and abrasive, the wafer is polished on a polishing clot in plastic at a defined contact force under a rotatory motion of the polishing cloth and the wafer. While the polishing process is under way the polishing agent (a slurry) will flow onto the polishing cloth and form a film between the clot and the wafer. The slurry which is used consists of a chemically offensive solution to which particles such as silica are added in a colloidal suspension.

From DE 195 44 328 or the company document "CMP Plaster Tool System Planarization Chemical Mechanical Polishing" published by the Wolters GmbH company in March, 1996, it has been known to provide appropriate stations and devices for such polishing processes. The wafers are retained by holders in processing units and are pressed by them against the polishing working surface. The holders or holding heads are connected to a spindle of a driving machine which is supported to be adjustable in height in order to press the wafer against the working surface. To obtain sufficient planarity, the lower support plate which holds the wafer via vacuum channels or bores is hinged by a universal joint to a carrier portion which, in turn, is connected to the spindle of the driving mechanism. The contact pressure is applied to the support plate via the universal joint.

From DE 197 55 975 A1, it further has become known to guide a support plate for the known holder in a carrier so as to be movable in height and to dispose an annularly closed membrane between the carrier portion and the support plate. The enclosed inner space of the membrane is optionally connected to the atmosphere or a vacuum or a fluid source under pressure. The pressure and vacuum help in displacing the support plate relative to the carrier. In this way, the contact pressure is applied to the support plate on a large surface, which causes an improved result to be obtained in planarization.

Apart from influencing other parameters such as the speed of the wafer, the speed of the polishing disk, the oscillating motions of the polishing head, the supply of polishing agent, and the condition and wear of the polishing cloths, the accuracy and uniformity which can be achieved will have an effect on the result of polishing in the CMP process. Planarized films of 300 mm wafers which are processed by CMP machines frequently present a rotationally symmetric, differentiated surface geometry which is characterized by a heavily polished wafer border, the removal of material is least at a small distance from the wafer border, i.e. 3 mm, and the largest removal of material is achieved about 20 mm from the wafer border.

From EP 0 922 531 A1, it has become known to use membranes of elastomeric material, which are disposed at the underside of the support plate and are pressed against the wafers by means of compressed air, for the described holders for wafers (chucks or chuck plates). This way helps obtain a better compensation of non-uniform areas. The membranes are thin-walled moulded-rubber parts to which compressed air can be applied via bores in the support plate. A holder of this type is constructed as a unit and the contact pressure acting on the wafer during the polishing process is exclusively exerted via the membrane. Apart from performing its function of transmitting the polishing pressure and the torque to the wafer, the holder also has to be capable of lifting the wafer from the polishing disk, thus overcoming adhesion between the wafer and the polishing disk. It is known to realize this operation by producing a negative pressure at the back of the wafer.

A disadvantage in all of the known designs is the fact that the membranes, in turn, are sucked into ring-shaped or sucker-shaped indentations to produce the vacuum required for suction in order to generate chambers having a negative pressure in this way. This causes the membrane to expand to a relatively large extent and to rapidly undergo wear, as a consequence. Moreover, the membrane has to be designed with very thin walls, the disadvantage being that a torque can be transmitted to the wafer only to a low efficiency. Membranes which are known are about 0.5 mm in thickness.

It is the object of the invention to improve a holder provided with a membrane to the effect that it is given a higher stability in standing and may also be employed in a more differentiated manner in order to achieve a geometry of material removal which is as uniform as possible.

BRIEF SUMMARY OF THE INVENTION

The inventive holder relies on a construction in which the support plate is suspended from the carrier portion via a ring-shaped membrane and compressed air, an atmosphere or a negative pressure can be optionally applied to the pressure chamber defined between these components. In this way, the contact pressure of the support plate on the workpiece, particularly on the wafer, can be produced by compressed air and the suspension of the support plate via a universal joint permits the support plate to soundly rest on the workpiece with no danger of chocking. As was stated above a holder of this type is known as such. According to the invention, it is provided with a contact membrane which is appropriately mounted at the border of the support plate in an air-tight way. Thus, the gap between the membrane and the support plate may be pressurized so that the axial force to press the head against the workpiece is produced, on one hand, and a pressure cushion is built up between the support plate and the membrane and provides for an appropriate yielding resilience to exist between the membrane and the workpiece, which reduces non-uniformities in the removal of material. Changing the pressure allows the contact pressure to vary, which achieves a further advantage, in that, if an atmosphere is applied to the pressure chamber the sole force of the weight exerted by the support plate can be used as a polishing force, which leads to a geometry of material removal which differs from the one if compressed air is applied to the membrane.

According to the invention, it is contemplated that the back of the membrane has socket-shaped lugs which are integrally formed to the membrane and extend into bores of the membrane. The socket-shaped lugs are provided with appropriate junctions for connection to a feed line which is located within the pressure chamber and is adapted to be connected, in turn, to a vacuum source. In this way, the negative pressure necessary for holding and, in particular, moving the workpiece is produced directly at the underside of the membrane with no need to deform the membrane for this purpose. Thus, it is unnecessary to expand or upset the membrane to achieve the vacuum required to move the wafer. Therefore, the membrane may be designed with relatively thick walls, e.g. having a thickness of at least 1.5 mm.

The invention helps in adjusting the polishing pressure differently. The force by which the head presses a wafer against the polishing cloth is composed of the weighting force of the support plate and the pressure which is produced in the pressure chamber between the support plate and the carrier portion and which also prevails between the underside of the support plate and the membrane. The differing way of applying forces causes a differing geometry of material removal. This one, for example, is not uniform at all for rigid support plates, but it has rather been shown that an intense removal of material is produced at the border of the wafer and is largely reduced at a slight distance from the border and will increase again towards the centre of the wafer. Naturally, efforts are made to obtain a geometry of material removal which is as uniform as possible. The inventive holder comes closer to this aim.

In an aspect of the invention, the support plate has a circular recess of a small depth which extends nearly up to the border of the support plate. Now, if the diameter of the membrane is chosen so as to coincide with the diameter of the workpiece, e.g. a wafer, the geometries of material removal which ensue therefrom are quite different, depending on whether working is done only by the weighting force of the support plate or by an extra contact pressure because of a positive pressure between the support plate and the carrier section.

According to an aspect of the invention, the socket-shaped lugs of the membrane are provided with junctions which, in turn, are in communication with a manifold line such as a closed-loop line. The manifold line as well as the junctions support themselves on the membrane via the socket-shaped lugs of the membrane. Thus, the manifold line "floats" in the pressure chamber.

BRIEF DESCRIPTION OF THE SEVERAL VIEWS OF THE DRAIWNGS

The invention will now be explained in more detail with reference to an embodiment shown in the drawings.

DETAILED DESCRIPTION OF THE INVENTION

While this invention maybe embodied in many different forms, there are described in detail herein a specific preferred embodiment of the invention. The description is an exemplification of the principles of the invention and is not intended to limit the invention to the particular embodiment illustrated.

Figure 1:
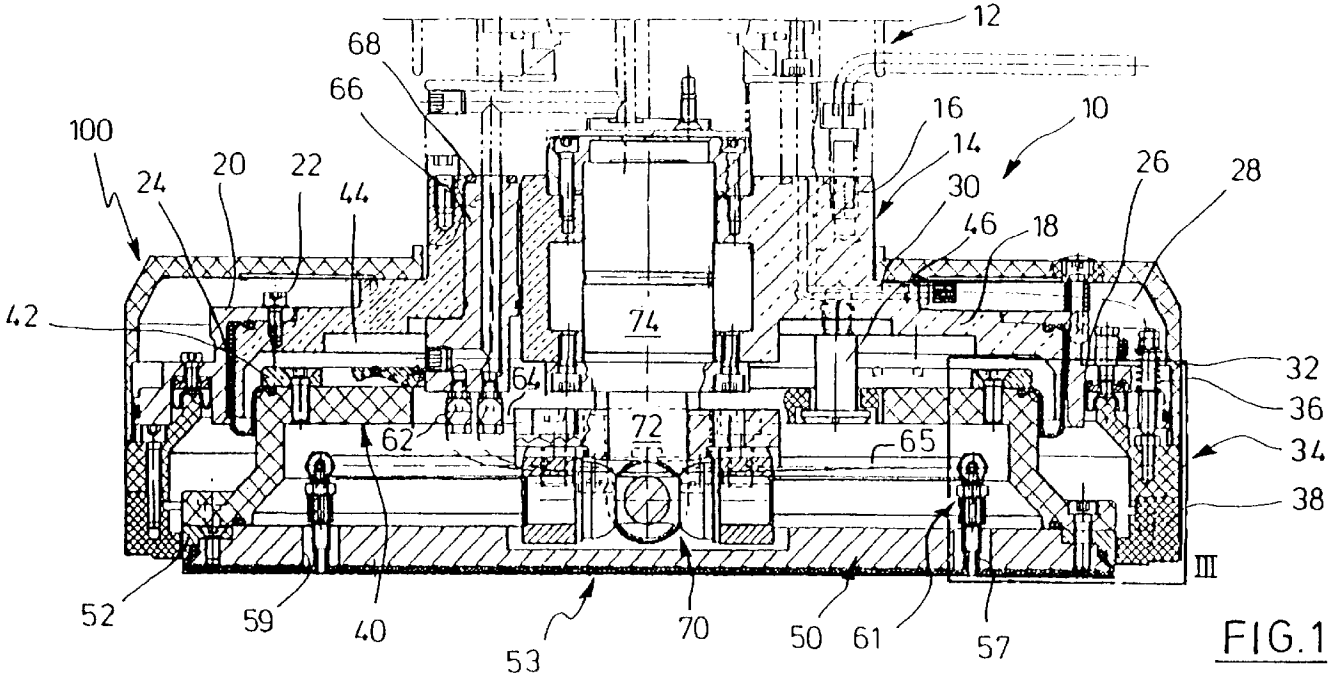
FIG. 1 shows a section through a holder according to the invention.

Referring to FIG. 1, a holder in the form of a retaining head 10 is mounted on a spindle 12 which is only shown in phantom lines. It is mounted by a bolted joint which is not referred to in detail. Mounting is done on a carrier portion 14 of the retaining head 10, which will be described in more detail below. The spindle 12 forms part of a driving mechanism, which is not further shown, of a device for chemico-mechanically polishing the surface of a semiconductor wafer. The spindle 12 not only is rotated, but can also be adjusted in height as is described, for example, in DE 197 55 975 A1 to which explicit reference is made here.

The carrier portion 14 has an axial collar 16 which is joined by an inversely pot-shaped flange 18. A ring-shaped retaining component 20 is fixed to the border of the flange 18 by means of bolts 22. Along with the flange 18, it pinches one end of a ring-shaped rolling membrane 24. The retaining component 20 further has mounted thereon, in a radially more outward position in a ring-shaped recess, a hose 26 which is adapted to be connected to a pressure source, which is not shown, via a flexible line 28 and respective bores 30 in the collar 16 and the spindle 12 to optionally cause the hose 26 to expand or contract. Finally, a retaining ring 34 is suspended from the ring-shaped component 20, i.e. via the bias of a spring 36, by means of pins 32 which are disposed at circumferential spacings. A radially inward portion of the retaining ring 34 bears against the hose 26. The hose 26 may help in axially moving the retaining ring 34 up and down. A ring-shaped sliding portion 38 made of a low-friction non-abrasive material is mounted at the underside of the retaining ring 34.

A bell-shaped portion 40 is coaxially arranged within the flange 24 at an axial distance therefrom. A ring 42 is fixed by a bolted joint to the upper surface of the bell-shaped portion 40. The other end of the rolling membrane 24 is pinched between the ring 42 and the bell-shaped portion 40. As a result, an enclosed chamber 44 is formed between the carrier portion 14 and the bell-shaped portion 40. This chamber can be optionally connected to a fluid source under pressure or a vacuum source, which is not shown herein. Thus, the fluid may serve for adjusting the bell-shaped portion 40 relative to the carrier portion 14 with downward adjustment being restricted by a pin 46 which is bolted into the flange 18 and has a head which limits the downward motion of the bell-shaped portion 40.

The bell-shaped portion 40 has connected to its border a support plate 50, i.e. via a locking ring 52 which is disposed between the radial flange of the bell-shaped portion 40 and a ring-shaped recess at the border of the support plate 50. The locking ring pinches the upwardly and backwardly turned border of a contact membrane 53 on the support plate 50. This is more evident from FIG. 3. The turned-up border of the membrane 53 with the bulge on the border is indicated by 55 in FIG. 3. The contact membrane 53 which is made of an elastomeric material and, for example, has a thickness of 1.5 mm or greater is provided with single socket-shaped lugs 57, which are integrally formed to the membrane body, at the side facing the support plate 50. The lugs 57, for instance, are located on a divided circle at an appropriate distance from each other. The lugs 57 extend through bores 59 of the support plate with the diameter of the bores 59 being clearly larger than the outer diameter of the lugs 57. A circular recess 60 which is of a relatively small depth is formed at the underside of the support plate 50. However, the recess does not extend up to the border of the support plate 50, but terminates at a certain distance therefrom.

As was mentioned already a pressure can be built up in the chamber 44 and acts on the support plate 50, trying to displace it relative to the carrier portion 14. This pressure also gets to the underside of the support plate 50 through the bore 59 and into the gap between the recess or the bottom of the recess 60 and the side of the contact membrane 53 that faces it. Thus, pressure is exerted on a workpiece such as a wafer via a membrane 53 which, in turn, is supported on an air cushion with the capability of the pressure cushion to transmit a pressure being dependent on the pressure prevailing in the chamber 44.

Junctions 61 are connected to the socket-shaped lugs 57 by inserting a socket 63 thereof into the lugs 52 under a press fit. The individual junctions 61 are connected to line portions which define a closed-loop line 65. The closed-loop line 65 is joined, via flexible lines, to two connections 62, 64 which are mounted on a sleeve 66 which is seated in a bore in the collar 16. The sleeve 66 has a central channel 68 which is in communication with respective bores in the spindle 12. A vacuum, a gas pressure or even water can be passed through these channels. In this way, a vacuum can be produced at the underside of the contact membrane 50 in order to move a workpiece from one processing position to another location.

The support plate 50, via a cardan joint 70 which is not shown in detail, is coupled to a cylindrical component 72 which, in turn, is axially guide in a casing 74 by means of a ball-type guide which cannot be seen. The casing 74 is located in the collar 16 of the carrier portion 14, which fact is not described in detail. This axially guides the support plate 50 in a precise way if displaced by a gaseous medium and the plate may be easily tilted in all directions.

Figure 2:
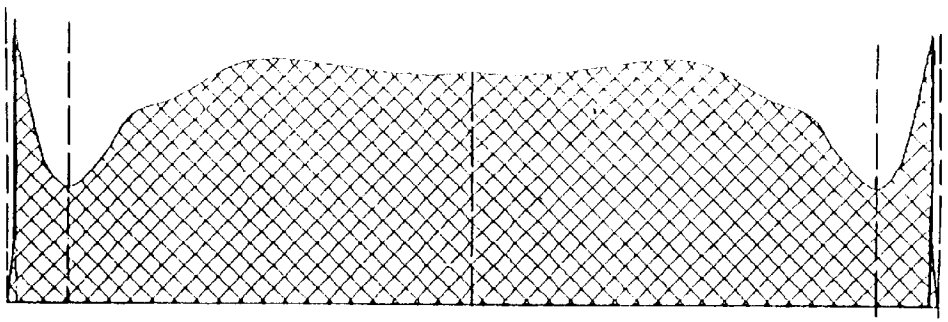
FIG. 2 shows a graph for material removal in polishing via the effective diameter of the holder of FIG. 1.
Figure 3:
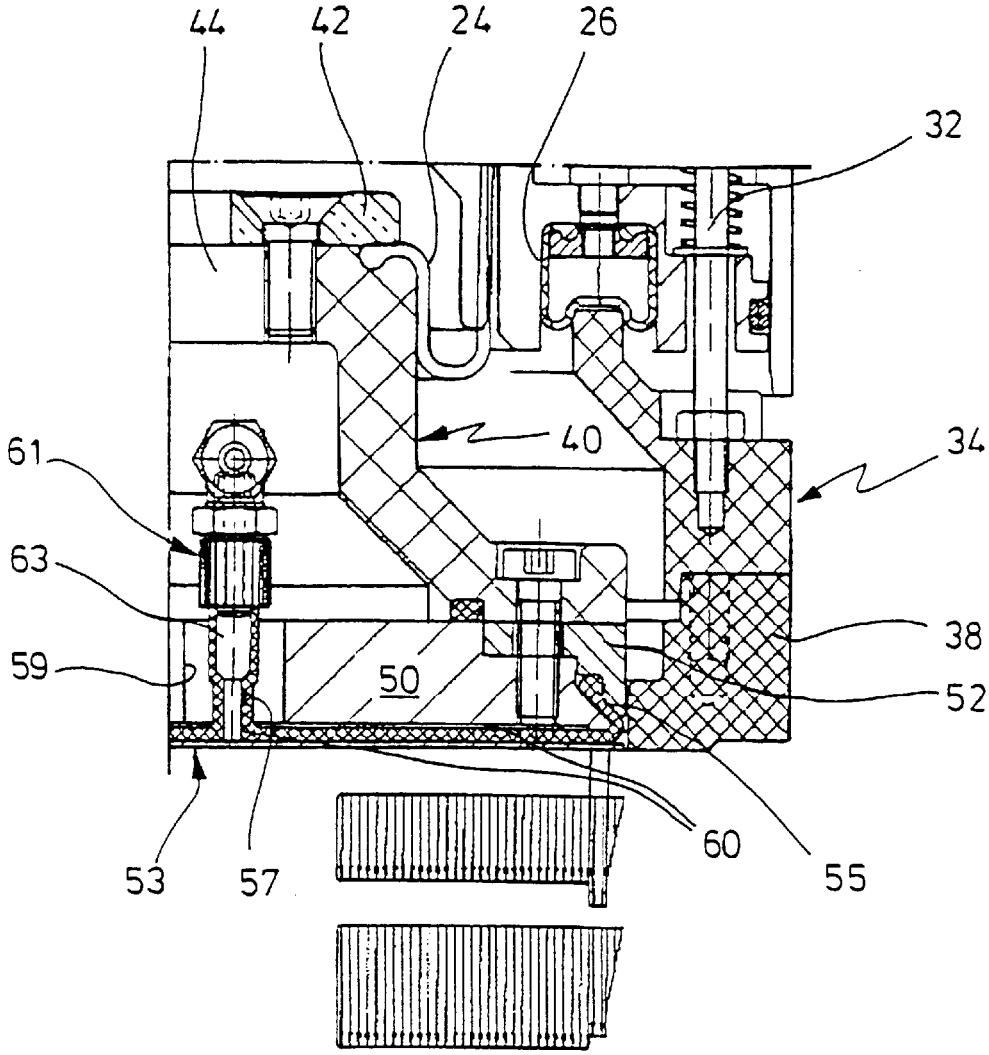
FIG. 3 shows a detail of FIG. 1 at a larger scale.

Referring to FIG. 3, two pressure graphs which represent the polishing pressure in the external area of the support plate 50 are shown below the detail on the retaining head of FIG. 1. The upper graph illustrates the case in which an atmospheric pressure exists in the chamber 44 and, thus, the assembly comprising the support plate 50 and the bell-shaped portion 40 rests on the wafer by the force exerted by its weight. Since the membrane directly bears on the underside of the support plate 50 in the external area of the support plate 50, which is contrary to the area below the recess 60, a polishing pressure which is somewhat larger is obtained in this area. This can be useful because there is no uniform removal of material across the diameter of the wafer as ensues from FIG. 2. Such non-uniformity is due to the fact that the polishing pressure which is applied is not equal at all points although such equality is naturally aimed at. Therefore, if the polishing pressure is increased in the area of the graph of FIG. 2 in which otherwise a minimal removal of material is found to exist an equalization of material removal is obtained during polishing.

The lower graph of the contact pressure of FIG. 3 depicts the case where a positive pressure is produced in the chamber 44 and will produce a polishing pressure on the wafer that is higher altogether, but does not make itself felt in the external area to a large extent because the external area of the membrane 53 directly bears on the support plate 50. Thus, the removal of material is smaller here, which might be desirable in certain cases and phases of polishing.

On the whole, the graph of FIG. 2 already shows a certain equalization of material removal by means of the tool shown as compared to the use of conventional tools.

The holder 10 which is shown operates as follows. A lowering motion onto a wafer, which is provided by means of the spindle 12 which is adjustable in height, causes the underside of the membrane 53 to get into engagement with the wafer surface facing it. Prior to it, the support plate 50 was shifted to the position raised at a maximum with respect to the carrier portion 14 by applying a vacuum to the chamber 44. Shortly before or during the contact with the wafer, the vacuum source applies a vacuum to the underside of the membrane 53 in the way described. This holds the wafer on the support plate and the wafer may now be moved to a working surface, e.g. a polishing disk. Above the polishing disk (not shown), the holder 10 is lowered to a predetermined position in which the wafer is at a minimum distance from the polishing cloth of the polishing disk, but does not contact it yet. Subsequently, the chamber 44 is connected to the atmosphere or a fluid source under pressure, which action moves the support plate 50 downwards and brings the wafer into engagement with the polishing disk. As was mentioned already the force of engagement (the polishing force) is determined by the pressure in the chamber 44 or in the gap between the support plate 50 and the membrane 53 or possibly by the weighting force alone. There is no need for a vacuum during the polishing process because the wafer is secured from rotation by means of the retaining ring 34.

Once the polishing operation is completed a vacuum is applied to the chamber 44 again and the hose 26 which was loaded before to press the retaining ring 34 to the polishing cloth is now relieved from load. The support plate 50 is slightly raised. The spindle 12 is moved up at the same time. The driving mechanism is moved to another position to deposit the wafer in another place. To this effect, the spindle is lowered in the new place and the wafer is released from the membrane 53 if the vacuum is removed from the underside of the membrane 53. It is also possible to apply a pressure shock instead via the lines and the socket-shaped lug 57 which were described.

Finally, it is to be noted that a protective hood 100 is mounted at the upper surface of the flange 18 and protects the interior of the retaining head 10. The hood 100 is not needed to operate the retaining head 10.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A holder for semiconductor wafers in an apparatus for chemical-mechanical polishing of semiconductor wafers, comprising:

a disk-shaped head having a carrier section which can be connected to a height adjustable spindle, the carrier section comprising a first linear guide means attached to the spindle or the carrier section;

a holding plate arranged below the carrier section and coupled thereto via a universal joint, the universal joint being attached to a second linear guide means which cooperates with the first linear guide means;

the holding plate having an upper and a lower side and comprising a number of vertical bores which extend to the lower side and the upper side of the holding plate;

a ring-shaped membrane attached to the carrier section and the holding plate which defines a pressure chamber between these components, the bores in the holding plate being connected with the pressure chamber;

a first junction in the carrier section to optionally connect the pressure chamber to atmosphere, a pressure source or a vacuum source, whereby the holding plate is axially displaced with respect to the carrier section;

a contact membrane of elastomeric gas-impermeable material having a peripheral edge which is fixedly connected to a peripheral portion of the holding plate in a gas-tight manner and engages the lower side of the holding plate;

socket-shaped lugs at the side of the contact membrane facing the lower side of the holding plate which extend through the bores in the holding plate and are provided with connections to a feed line within the pressure chamber the feed line being connectable to a vacuum source, and the bores and the lugs being dimensioned such that the pressure or the vacuum in the pressure chamber is communicated to a gap between the lower side of the holding plate and the contact membrane.

2. The holder according to claim 1, characterized in that the contact membrane has a thickness of at least 1.5 mm.

3. The holder according to claim 1, characterized in that the border of the contact membrane is locked in place by means of spindles between the border of the support plate and a locking ring.

4. The holder according to claim 1, characterized in that the support plate has a circular recess of a small depth with a flat or concave bottom, which extends nearly up to the border of the support plate.

5. The holder according to claim 1, characterized in that the bores in the support plate into which the socket-shaped lugs extend have a diameter which is larger than the outer diameter of the lugs, which causes the second bores to define the first bores as well.

6. The holder according to claim 1, characterized in that a plurality of connections are connected to a manifold line in the pressure chamber which is solely supported on the connections.

* * * * *